US005666831A

United States Patent [19]

Doros

[11] Patent Number: 5,666,831

[45] Date of Patent: Sep. 16, 1997

[54] ANTI-TAMPERING LOCKING SYSTEM

[75] Inventor: Elizabeth Doros, Lucas, Tex.

[73] Assignee: MCI Corporation, Washington, D.C.

[21] Appl. No.: 451,254

[22] Filed: May 26, 1995

[51] Int. Cl.[6] ..... E05B 63/00

[52] U.S. Cl. ..... 70/140; 70/34; 70/232; 411/910; 81/436; 292/291

[58] Field of Search ..... 70/32–34, 140, 70/232, 233, 416, 419, 423, DIG. 13, DIG. 57; 292/288, 289, 290, 291, 297, 300, 301; 411/910, 911, 919, 402–407, 436; 81/53.2, 121.1, 436, 461, 467, 475

[56] References Cited

U.S. PATENT DOCUMENTS

| | | | |
|---|---|---|---|
| 2,179,045 | 11/1939 | Lewis | 70/232 |
| 2,362,999 | 11/1944 | Hewitt | 411/403 |
| 2,686,447 | 8/1954 | Vock et al. | 81/53.2 |
| 3,400,626 | 9/1968 | Bergere | 411/405 |
| 3,496,742 | 2/1970 | Rothweiler et al. | 70/423 |
| 3,498,173 | 3/1970 | Wright | 411/403 |
| 4,027,572 | 6/1977 | Burge | 411/436 |
| 4,161,896 | 7/1979 | Creed | 411/910 |
| 4,170,918 | 10/1979 | Burge | 411/427 |
| 4,191,228 | 3/1980 | Fenton | 81/436 |
| 4,211,128 | 7/1980 | Plumer | 81/436 |
| 4,809,569 | 3/1989 | Erb | 411/910 X |
| 4,964,773 | 10/1990 | Schmidt | 70/232 X |
| 5,024,073 | 6/1991 | Lloyd | 70/34 X |
| 5,074,598 | 12/1991 | Masseth et al. | 411/396 X |
| 5,224,402 | 7/1993 | Pettersson | 81/467 |
| 5,353,667 | 10/1994 | Wilner | 81/436 |
| 5,378,101 | 1/1995 | Olson et al. | 411/405 |
| 5,433,094 | 7/1995 | Sandin et al. | 70/232 X |

FOREIGN PATENT DOCUMENTS

| | | | |
|---|---|---|---|
| 2229218 | 9/1990 | United Kingdom | 292/291 |

*Primary Examiner*—Suzanne Dino

[57] ABSTRACT

A locking system comprising a locking fastener having tamper-resistant features, and a special key having a bit at one end for engaging a socket in the head of the locking fastener to rotate the latter. The internal configuration of the socket corresponds to an external configuration of the bit, and the corresponding contour of the socket prevents the fastener from being turned by tools other than the special key. The fastener may have left-handed threads on its shaft and its head may be recessed in a counterbore in a closure part to prevent gripping tools from gripping an external surface of the head. The configurations of both the socket and the key may readily be made by economical metal working techniques.

21 Claims, 4 Drawing Sheets

ANTI-TAMPERING LOCKING SYSTEM

FIELD OF THE INVENTION

The invention relates to locking systems and more particularly to a locking system having an elongated fastener such as a screw or bolt with a recess in the head thereof for receiving a special tool or key with which to rotate the fastener.

BACKGROUND OF THE INVENTION

Screws with heads requiring special tools for turning the screw are well known and have been used in the past to prevent tampering or unauthorized removal by persons lacking the special tool, which will be referred to hereafter as the key. In other words, unauthorized removal of the screw is thwarted because the screw cannot be turned with tools other than the special key.

In outdoor environments, especially areas accessible to the general public, unauthorized persons may be tempted to remove ordinary type screw fasteners and thereby enter enclosures secured by these fasteners, which can lead to damage of the fasteners, or theft, damage or other loss of equipment or other valuables within the enclosures. One important use of such screw type fasteners is to lock telephone equipment within a protective enclosure. The protective enclosure may be an above-ground shed or cabinet having a screw-secured door, or may be an underground chamber having a screw secured cover, such as a manhole cover. Although the prior art discloses many fasteners of the screw type, that are said to be tamper-resistant, these fasteners and the special tools for operating them are difficult and expensive to manufacture.

SUMMARY OF THE INVENTION

The invention provides a locking system that is relatively easy and inexpensive to manufacture. It comprises a threaded locking screw having a head with a special recess. A special tool or key has a bit receivable in the recess and operable to turn the screw. The recess provided in the head of the screw is designed to be engaged only by the bit of the specialized key for causing rotation of the screw. Thus, the shape of this recess has a special form such that a conventional screwdriver, socket wrench or similar tool, when positioned in the recess, cannot be made to engage the wall thereof in a manner providing sufficient leverage to cause the screw to rotate.

The locking system may also include a closure member or element having a special counterbore or other receptacle for receiving the head of the locking screw and conforming to the exterior thereof to prevent gripping an external surface of the head by application of a wrench or pliers to rotate the screw. In addition, the screw preferably has left-handed threads to further complicate the operation thereof by an unauthorized person. The locking system is thus rendered substantially tamper-proof insofar as an unauthorized person being able to remove the screw by using conventional tools to affect rotation thereof.

The invention therefore provides a locking system comprising closure means, a locking screw for securing the closure means in a closed position, and a key for turning the locking screw between locked and unlocked positions. The closure means may comprise a closure member, or a closure element for engaging a closure member to keep the latter in a closed position. The cost of manufacturing the locking system is minimized because the components of the system, i.e., the locking screw, the special key and the closure means, may all be manufactured using inexpensive machining techniques, such as those utilizing metal working drills and lathes.

The locking screw has a shaft with external threads at one end and a head at the other end. The head has a specially contoured axial socket for receiving a special contour of the bit of the key. The key also has a shank connecting the bit to a handle for turning the key, which causes the external threads of the screw to engage internal threads tapped into a counter-member, such as a backing plate or a door or manhole frame, so that the head of the screw may be tightened against the closure means to secure it in its closed position. Thus, the threads of the counter-member serve as a screw retaining means.

The closure means comprises a body having a bore for receiving the shaft of the screw and a counterbore providing a receptacle for receiving the screw head. A sidewall of this head receptacle is in close enough proximity to and fully surrounds the head of the screw on all sides to prevent a gripping tool, such as pliers or a wrench, from getting a grip on an external surface of the head sufficient to rotate the screw without the special key.

The axial socket within the head of the screw is defined by a bottom wall and the sidewall, which has an interior contour that prevents conventional insertion tools, such as screwdrivers, from engaging the sidewall of the socket with sufficient force to rotate the screw. The interior contour of a major portion of the socket sidewall is preferably substantially cylindrical for more than one-half, preferably more than two-thirds, more preferably more than three-quarters, of its total periphery. The remaining portion of the sidewall is provided by a groove forming a lateral arch defined by an arc having a radius substantially less than the radius of the cylindrical portion of the socket. The radius of the arc is preferably equal to or less than two-thirds, more preferably three-fifths, and most preferably about one-half, of the radius of the cylindrical portion of the socket. In addition, the origin of the arc radius lies within a chord of a circle defined by the radius of the cylindrical portion of the socket, and the ends of this chord correspond to the two points at which the arc intersects this circle. The resulting peripheral shape of the socket corresponds to an identical peripheral shape of the key bit as described below.

Such a cylindrical socket with an arched groove has no corners or other contours that might be engaged by screw drivers, socket wrenches or the like to apply rotative force to turn the screw. For this reason, once the locking screw of the invention is fully seated, it is immune from tampering because it may be operated only by a person having the special key as described below.

The bit of the key has an external contour conforming to the internal contour of the socket and has a cross-sectional area slightly less than that of the socket such that the bit is adapted to be received axially in the socket with a sufficiently close fit that a turning force applied to the handle of the key will cause the screw to rotate while in threaded engagement with the counter-member.

The bit preferably comprises a substantially cylindrical body defining an axial channel with an elongated slot, and an elongated pin receivable and fixed in the channel. The pin has a cross-sectional shape that causes a lateral portion thereof, preferably a minor portion, to extend through and project beyond the slot to form a laterally projecting tooth. In addition, the pin has a base that fits within the axial channel and has width greater than that of the slot such that the edge of the slot engages the base of the pin to secure the pin against lateral movement relative to the channel.

For ease of manufacture, the axial channel is preferably drilled out with a conventional drill and the pin is preferably a conventional dowel pin of substantially cylindrical cross section. The pin is preferably fixed in the channel by means of solder or an adhesive composition. In this configuration, the cross section of the dowel pin defines a small circle overlapping a larger circle defined by the cross section of the bit body, the intersection of these two circles defining a chord corresponding to the chord of the screw socket described above.

Thus, the laterally projecting tooth of the bit is also in the form of an arch. The arc radius of this arch is preferably equal to or less than two-thirds, more preferably three-fifths, and most preferably about one-half, of the radius of the cylindrical portion of the bit body. In addition, the origin of the arc radius lies within a chord of a circle defined by the radius of the cylindrical portion of the socket, and the ends of this chord correspond to the two points at which the arc of the tooth intersects this circle. The resulting peripheral shape of the socket corresponds to an identical peripheral shape of the socket as described above.

Although the preferred embodiment of the present invention is a screw type fastener having a head at one end and an exteriorly threaded shaft at the other end, the invention may be incorporated in other designs of screws, bolts and similar fasteners. For example, the means of engagement between the screw or bolt shaft and the counter-member may be cooperating external and internal projections other than continuous threads.

BRIEF DESCRIPTION OF THE DRAWINGS

The features of the invention and its objects and advantages may be further understood from the detailed description below taken in conjunction with the accompanying drawings, in which.

DETAILED DESCRIPTION OF THE INVENTION

Figure 1:
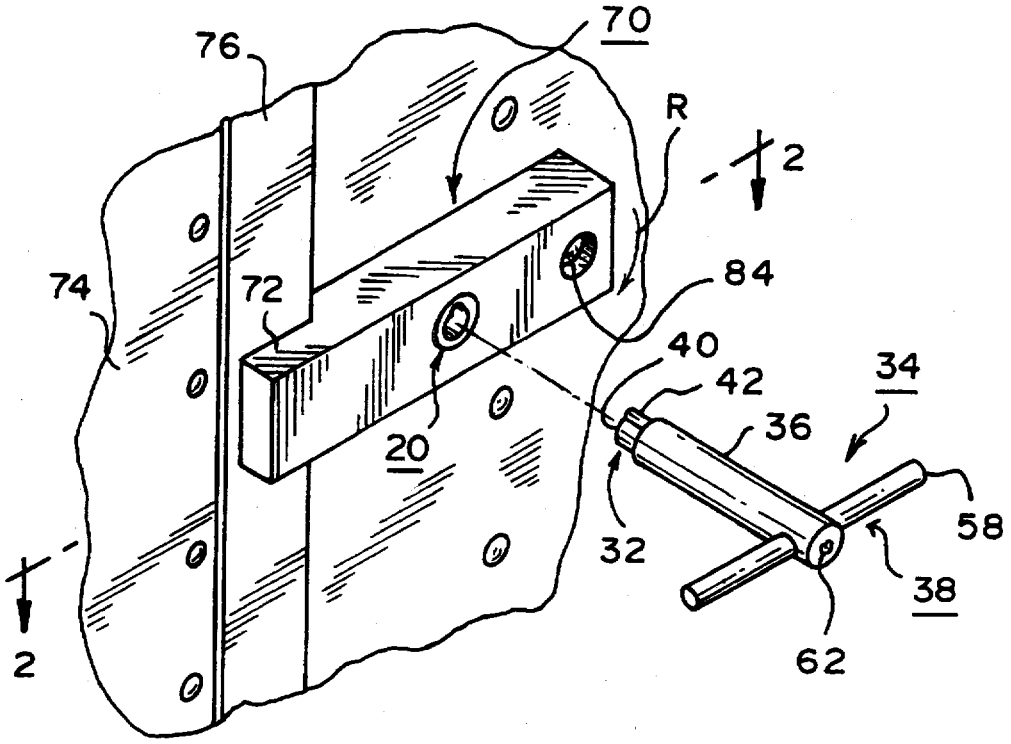
FIG. 1 is a perspective view of the invention as employed for locking shut the door of an enclosure.

Referring to FIGS. 1–6, a screw type locking fastener 20 has an elongated shaft 22 with a head 24 at one end and exterior threads 26 at the other end. The threads 26 are preferably left-handed to help prevent tampering by requiring clockwise rotation for removal, whereas conventional screws usually have right-handed threads requiring counter-clockwise rotation for removal.

The head 24 is enlarged relative to the shaft 22 for two reasons, one being so as to accommodate a relatively large size recess or socket 28 having a substantially circular sidewall 29 and a lateral groove 30, the configuration of which is described more fully below. The socket 28 is configured to receive the bit 32 of a special operating tool or key, generally designated 34. Key 34 also comprises a shank 36 and a handle 38, the latter being located near the opposite end of the shank from the bit.

Near the handle end of key shank 36 is a transverse aperture 56, which receives a rod 58 for providing key handle 38. For the purpose of fixing handle rod 58 within aperture 56, a retaining pin 60 is crimped and forced through a hole 62 in the handle end of shank 36 (FIG. 1) and into a transverse hole 64 in handle rod 58 (FIG. 9).

The bit 32 of key 34 has a substantially cylindrical body 40 corresponding to the substantially cylindrical wall portion 29 of axial socket 28, and a lateral projection or tooth 42 corresponding to the groove portion 30 of socket 28. The bit 32 is therefore configured to be received tightly within the socket 28 and to thereby engage the groove thereof for rotating the locking screw 20 in either direction. On the other hand, the particular configuration of socket 28 is such as to make it extremely difficult to rotate the locking screw by inserting in the socket any tool other than the bit 32 of key 34, which has a cross section corresponding very closely to the precise cross section of the socket.

Figure 7:
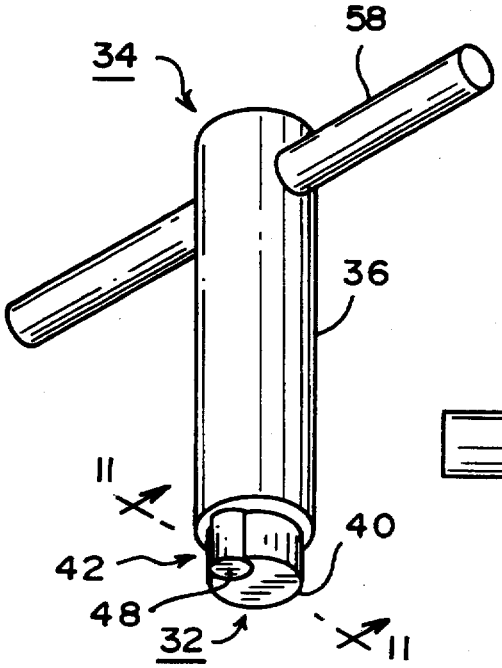
FIG. 7 is a perspective view of the key of the invention for rotatably engaging the threaded fastener of FIG. 4.
Figure 8:
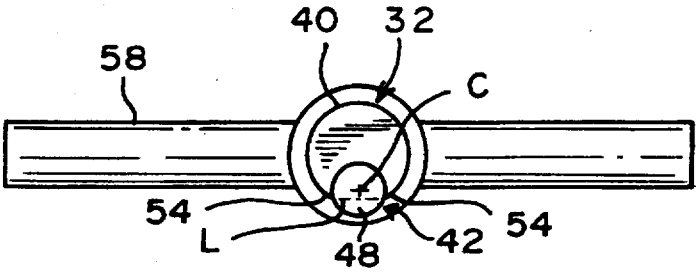
FIG. 8 is an end view of the bit of the key of FIG. 7.
Figure 9:
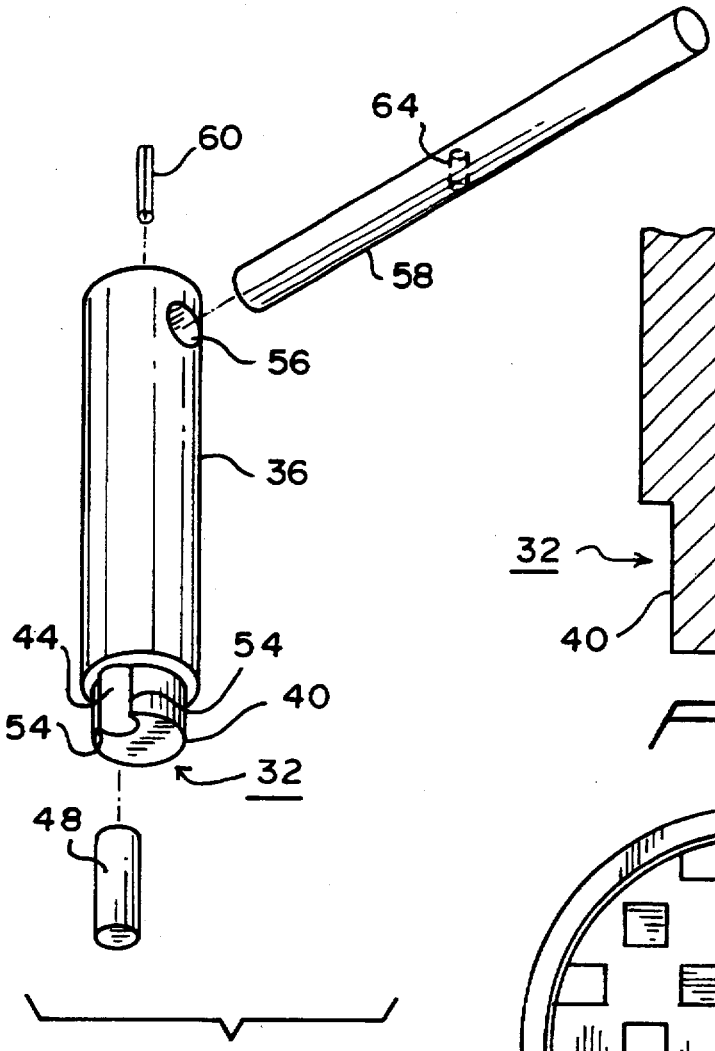
FIG. 9 is a exploded view of the key of FIG. 7.
Figure 11:
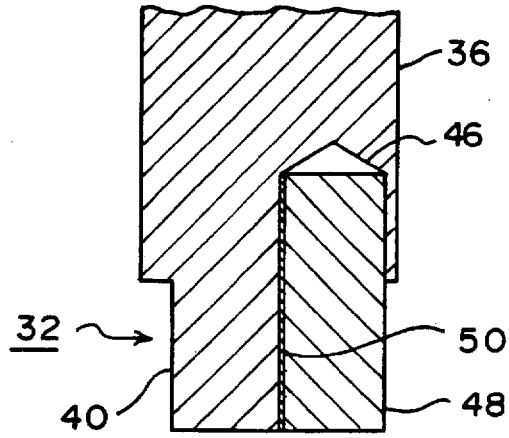
FIG. 11 is a fragmentary sectional view taken along lines 11—11 of FIG. 7.

Referring now to FIGS. 7–11, the structure of key 34 will be described in more detail. The cylindrical body 40 of bit 32 has an axial channel 44 of generally circular cross section, which intersects the periphery of the body 40 to form an axial slot 52. The body periphery is therefore defined by an arc constituting the major portion of the circumference of a circle. Channel 44 is preferably made by drilling through the distal end of the bit body 40 in a direction parallel to the axis of the elongated shank 36. This drilling may be extended beyond the axial extent of bit body 40 and into the body of shank 36 to form a dead-end receptacle 46 for receiving the proximate end portion of a dowel pin 48, the distal end portion of which is received in the remaining portion of axial channel 44. The dowel pin 48 is preferably fixed in the receptacle 46 and channel 44 by a layer 50 of an adhesive composition or a solder, preferably silver solder.

Where the dowel pin is substantially cylindrical, as is dowel pin 48, a major portion (more than one-half) of the cross-sectional area of the dowel pin resides within the channel 44, such that a minor portion (less than one-half) of the cross-sectional area of the dowel pin projects beyond the circular contour defined by the outer periphery of the bit body (FIGS. 7–9). This projecting portion of the dowel pin forms the radially projecting lateral tooth 42 of the key bit 32. This relationship is achieved by drilling out channel 44 along an axis that is parallel to and spaced from the axis of bit body 40 by a radial distance sufficient to provide the axial slot 52 with width a W substantially less than the diameter D of the dowel pin 48, as may be seen best in FIG. 10.

Because the slot width W is less than the maximum diameter of channel 44 (and also of pin 48), the channel 44 is provided with opposing undercut lips 54, 54 which extend over dowel pin 48 and thereby secure the dowel pin against lateral movement, irrespective of the presence or size of pin receptacle 46, which is optional and therefore may be omitted. However, it is preferable to provide receptacle 46 and to drill it to the same diameter as channel 44 in order to fix dowel pin 48 more securely in the channel 44 of bit 32. From the foregoing, it is evident that the lateral tooth 42 has an arch formed by the projecting portion of dowel pin 48 and that the overall contour of bit 32 is therefore a result of two intersecting circles, namely the larger circle constituted by the circular cross section of bit body 40 and the smaller circle constituted by the circular cross section of the dowel pin 48.

Figure 4:
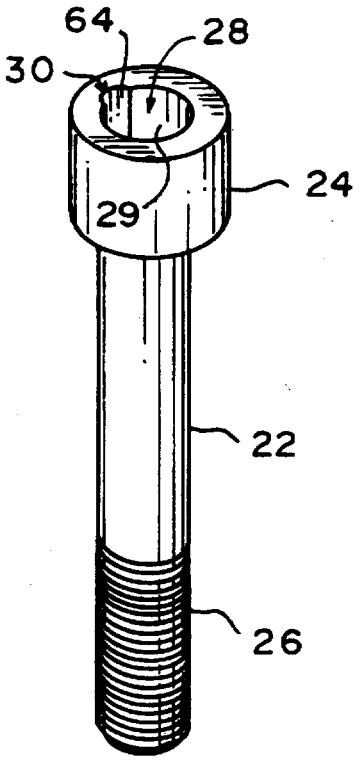
FIG. 4 is a perspective view of the threaded locking fastener of the invention.
Figure 6:
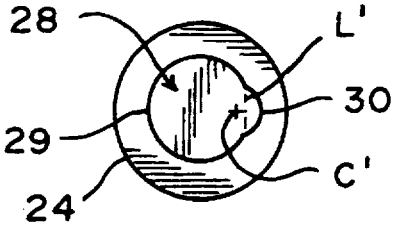
FIG. 6 is an end view of the head of the fastener of FIGS. 4 and 5.
Figure 5:
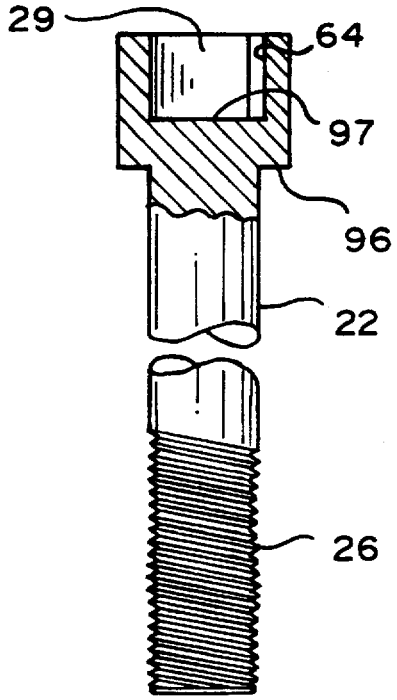
FIG. 5 is a fragmentary elevational view in partial section of the fastener of FIG. 4.

Referring now to FIGS. 4–6, it may be seen that socket 28 of the locking screw has an inner contour of substantially identical shape as the outer contour of bit 32. However, the former has a slightly larger cross-sectional area than the latter to permit the bit 32 to fit snugly within the socket 28. In other words, the contour of socket 28 is also formed by two intersecting circles, the larger circle being constituted by the cylindrical socket wall 29 and the smaller circle being constituted by the wall 64 of lateral groove 30. As may be seen best in FIG. 8, the center C of the smaller circle should always be radially within an imaginary chord line L connecting the points of intersection between the smaller and larger circles in order to form the undercut lips 54, 54 shown in FIG. 10.

Referring to FIG. 6, the relationship of the respective circles of the key bit 32 is the same as that of the corresponding circles of the locking screw socket 28, namely the center C' of the smaller circle should always be within an imaginary cord line L' connecting the interrupted edges of the larger circle. With respect to the above described small and large circles of both the socket 28 and the bit 32, the radius of the smaller circle is 10% to 70%, preferably 20% to 60%, more preferably 40% to 55%, and most preferably about 50%, of the radius of the larger circle.

Screw securing threads 26 are provided on the end portion of locking screw 20 opposite to screw head 24. Although threads 26 may be right-handed, they are preferably left-handed to make the locking system more tamper resistant as previously explained.

As evident from the foregoing, the bit 32 is so formed that it can be fitted into the screw head socket 28 in only one relative position, namely, the position in which tooth 42 of key 34 occupies the lateral groove 30 of the screw head 24. Although a circular bit body 40 and a uniform radius arch forming radially projecting tooth 42 are preferred, some variances in these contours and in the corresponding contours of socket 28 are possible, as long as the channel 44 for receiving dowel pin 48 is provided with undercut lips 54, 54. In other words, the base portion 49 of dowel pin 48 within channel 44 must have a maximum dimension greater than the width of slot 52 so that the dowel pin base 49 is secured laterally within channel 44 by lips 54, 54 or equivalent. In this regard see the discussion of FIG. 14 below.

Figures 3, 14:
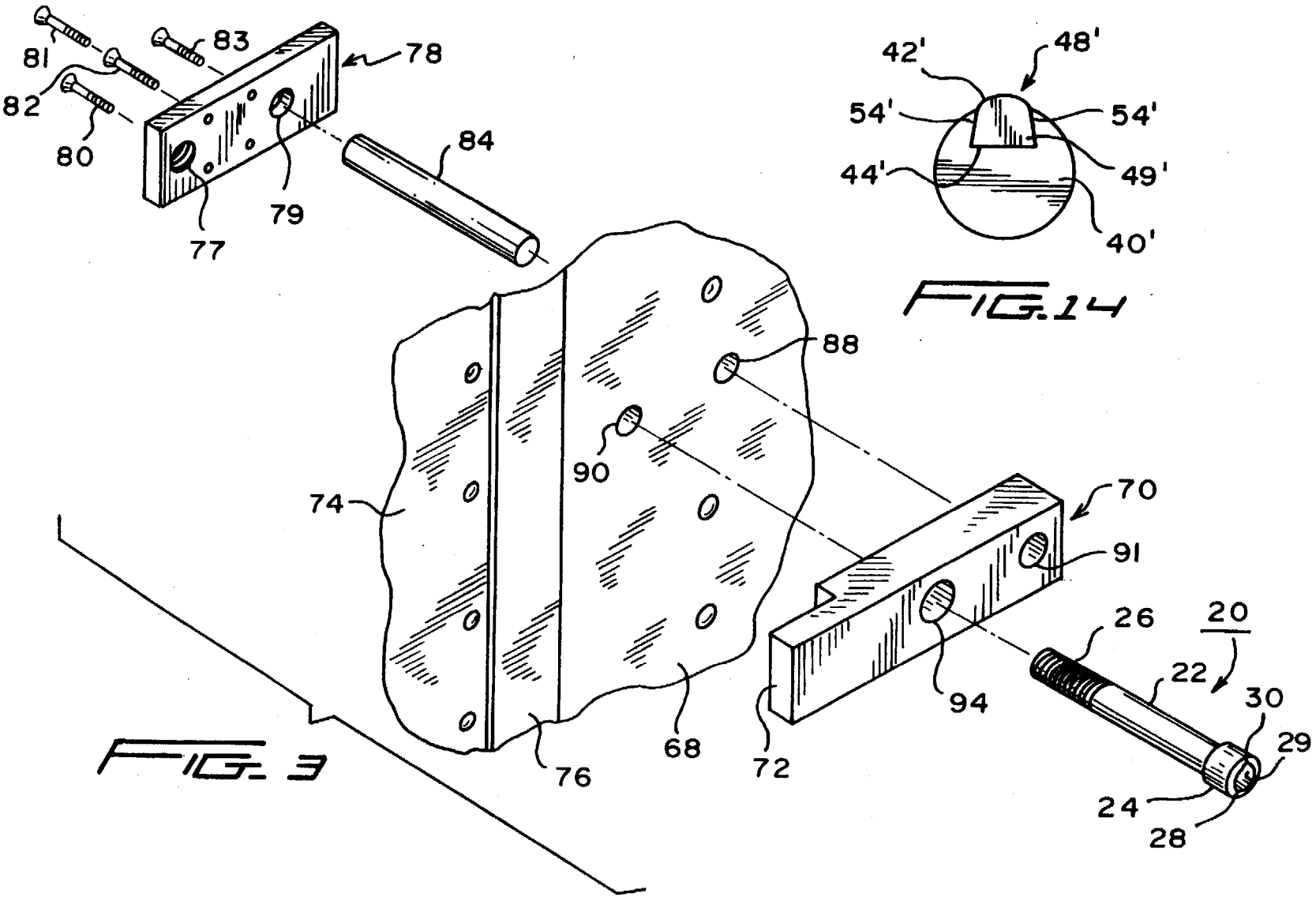
FIG. 3 is an exploded view of the embodiment of the invention illustrated in FIGS. 1 and 2.

Operation of the locking system of the invention will now be described with respect to the embodiment thereof shown in FIGS. 1–3. In these figures, the locking screw 20 is shown detachably securing to an enclosure wall 68 a locking bar 70 which has at one end a longitudinally extending finger 72 for engaging and holding in its closed position an enclosure door 74, such as a door to a shed or cabinet for telephone equipment. Along the edge of the door engaged by the finger 72 is a U-shaped metal reinforcing strip 76. In its locked position, the external threads 26 of the locking screw 20 extend as far as possible into an aperture 77 containing cooperating internal threads of a backing plate 78, which is secured to the inside surface of the enclosure wall 68 by means of four mounting screws 80, 81, 82 and 83.

The backing plate 78 has a second aperture 79 in which is secured an anti-rotation rod 84 by means of a weld 86. In order to mount the backing plate with rod 84 welded thereto, and also to provide for passage of locking screw 20 through the wall 68, a rod aperture 88 and a screw aperture 90 are pre-drilled through enclosure wall 68. It should also be apparent that the functional features of the backing plate may be incorporated directly into the enclosure wall 68, such as by providing threads in screw aperture 90 and by welding rod 84 directly into rod aperture 88.

The locking bar 70 also contains a pre-drilled rod bore 91 and a screw bore 92 for receiving respectively the distal end of rod 84 and the screw shaft 22. The purpose of rod 84 is to prevent rotation of locking bar 70 when locking screw 20 is fully seated with its threads engaged in backing plate 78. On the other hand, upon loosening locking screw 20 while keeping at least some of its threads 26 engaged with the corresponding threads of backing plate 78, the end of the locking bar opposite to finger 72 may be lifted over the distal end of rod 84 in the direction of arrow L in FIG. 2, such that the locking bar 70 may be rotated clockwise as indicated by arrow R in FIG. 1 to disengage finger 72 from the edge of enclosure door 74, thereby permitting door 74 to be opened.

Figure 2:
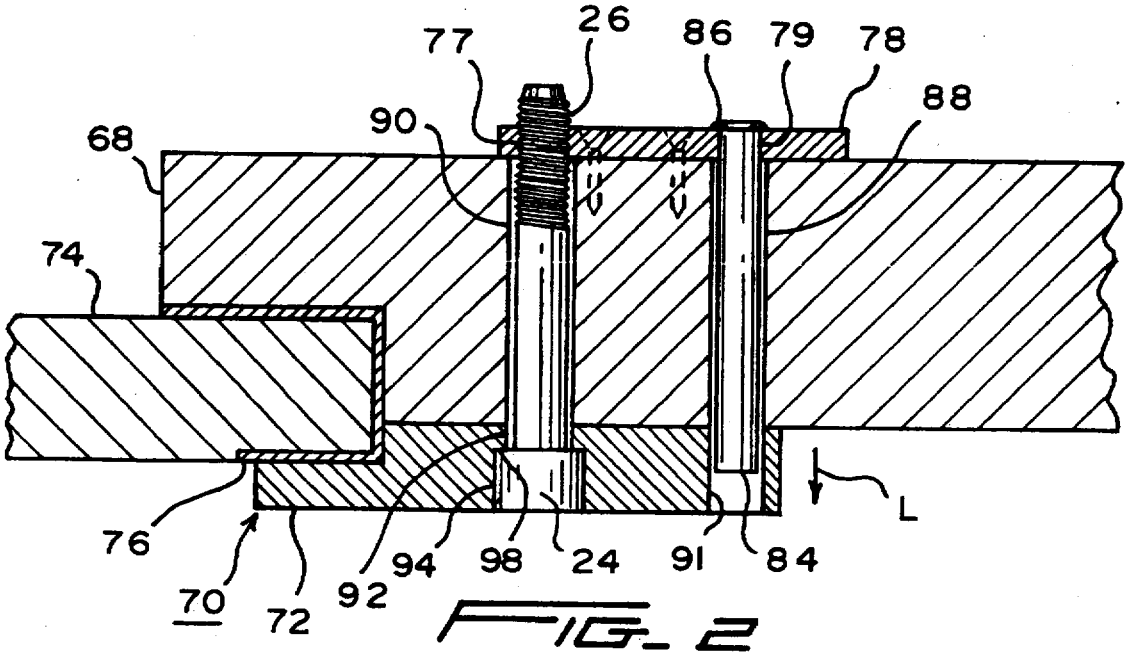
FIG. 2 is a cross-sectional view taken along lines 2—2 of FIG. 1.

As may be seen in FIG. 2, the shaft 22 of the locking screw passes through the bore 92 in locking bar 70, while the screw head 24 fits closely within a head receptacle provided by a counterbore 94. Thus, the diameter of head 24 is greater than that of shaft 22 so as to form a seating surface 96 on the underside of head 24 (FIG. 5) for engaging a screw head seat 98 formed in the locking bar 70 by the difference in diameters between the bore 92 and the counterbore 94.

In order to fully seat locking screw 20 in backing plate 78, or to partially or fully release the locking screw from the backing plate, the bit 32 of key 34, when in a single aligned orientation, may be inserted axially within socket 28 until the tip of the bit abuts the bottom wall 97 of the socket (FIG. 5). Upon such insertion, a turning force applied to the key by its handle 38 will rotate both the key 34 and the locking screw 20, a counterclockwise turning force tightening and a clockwise turning force loosening the locking screw when it has left-handed threads.

When the key and screw are so engaged, the lateral tooth 42 is securely received within the lateral groove 30 and fully occupies the groove so as to transmit to the head 24 of the locking screw 20 any turning force applied to handle 38. In other words, when the axial bit 32 is fully seated in the axial socket 28, the screw is then engaged for rotation with the key such that turning of the key transmits rotary movement to the screw because of the engagement between the lateral tooth 42 and the lateral groove 30.

Another important feature of the invention is that the wall of counterbore 94 is in close proximity to the exterior surface of the screw head 24. This prevents the application of any gripping tool, such as pliers or a wrench, to the exterior surface of head 24 so as to cause rotation thereof without the special key 34. Thus, the recessing of head 24 within counterbore 94 is another anti-tampering feature of the invention. Although the cylindrical head shape shown in the drawings is preferred, other shapes, such as the hemispherical head shape commonly found on screws, are possible, provided the head shape selected will accommodate recess 28 and is fully recessed and fits closely within the counterbore 94.

Figure 12:
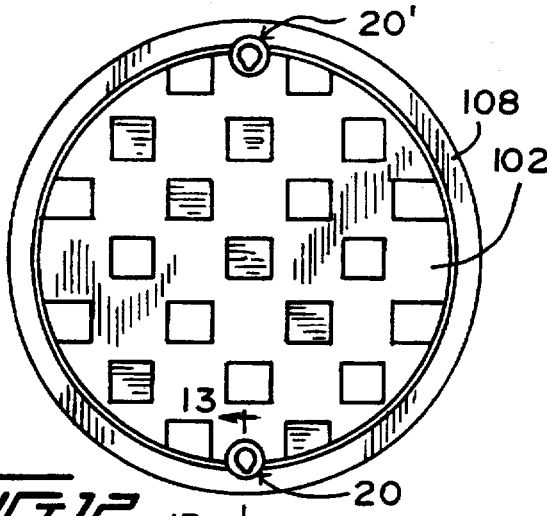
FIG. 12 is a plan view of a second embodiment of the invention.
Figure 10:
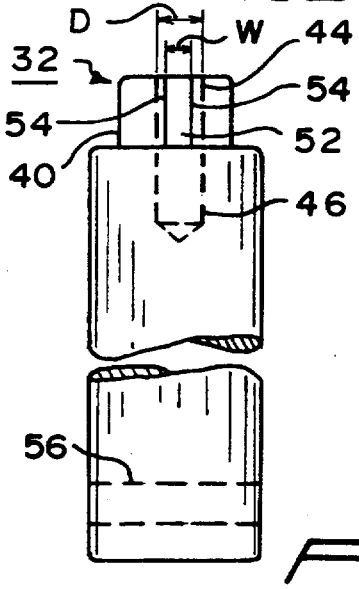
FIG. 10 is a fragmentary elevational view of the key of FIG. 7 with the handle element removed.
Figure 13:
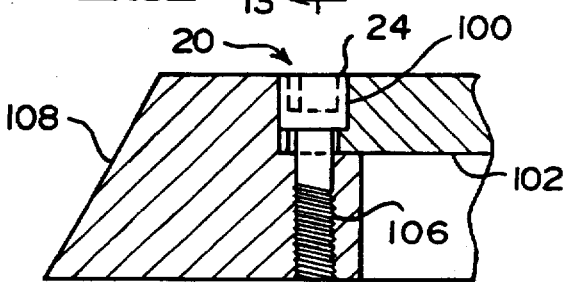
FIG. 13 is a fragmentary sectional view of the second embodiment taken along lines 13—13 of FIG. 12; and, FIG. 14 is an end view showing a modification of the bit of the key component of the invention.

FIGS. 12 and 13 show a modification of the invention wherein the need for a separate locking member, such as locking bar 70, is eliminated by providing a receptacle for the head of the locking screw directly in the closure member itself. In this embodiment, a receptacle for the screw head 24 is provided by a counterbore 100 formed at or adjacent to the periphery of a manhole cover 102. Counterbore 100 communicates with a bore 104 in cover 102, and bore 104 is aligned with a threaded aperture 106 in a manhole cover frame 108. The internal threads of aperture 106 are engaged by the threads 26 of the locking screw 20 to lock cover 102 in a closed position. Here again, the wall of counterbore 100 is in close proximity to the outer surface of screw head 24 such that the locking screw 20 can be rotated in either direction only by inserting the bit 32 of key 34 into the socket 28 of screw head 24. Preferably, a second locking screw 20', identical to locking screw 20, is used to secure the opposite side of cover 102 by means of the same locking structure as shown in FIG. 13 for locking screw 20.

The dowel pin component of the bit, which is inserted axially in the channel provided in the body of the bit, may have shapes other than a cylindrical shape, the latter being shown in the drawings as an illustrative example. An example of a different cross-sectional configuration of the dowel pin component of the key bit is illustrated in FIG. 14, which shows a modified dowel pin 48' having a radially projecting lateral tooth 42' and a trapezoidal base 49' held within an axial channel 44' by undercut lips 54', 54'. The dowel pin could also have a shape resembling a FIG. 8 and the outer segment of this shape beyond the slot could be larger than the inner segment within channel 44. Dowel pins having such non-circular cross sections are not preferred because of the additional expense associated with machining such non-circular pins and non-circular channels for receiving the same.

As evident from the foregoing, the locking screw of the present invention can only be rotated by a bit which has the same configuration as the socket in the head of the screw. No other bit configuration will both fit within the socket and engage the walls of the socket so that when the key is rotated, the locking screw will be caused to rotate with it. Furthermore, the bit is readily assembled from two components that are easily manufactured.

The closure means secured by the locking screw and key combination may comprise a locking element separate from a closure element, or a closure element with the locking element features incorporated directly in a portion thereof. Thus, the locking element portion may comprise a screw head receptacle and seat incorporated directly in a door or other closure element. Similarly, as already described, the functional features (threaded aperture and projecting rod) of the backing plate may be incorporated directly in an enclosure wall or door frame. Many other modifications and alternatives are possible and these may occur to those skilled in the art who become familiar with the instant disclosure. Such modifications and alternatives are intended to be within the scope of the invention as defined by the claims set forth below.

What is claimed is:

1. A locking system comprising:

a fastener having a socket at one end of a shaft, and means at the other end of the shaft for engaging a retaining means upon rotation of the fastener; and, a key having a shank with a handle means at one end, and at the other end a bit receivable in said socket and adapted to engage a portion of said socket for rotating said fastener when said shank is rotated by said handle means, said bit comprising:

a bit body defining an axial channel and an axial slot communicating with said channel and having a width less than a maximum transverse dimension of said channel, and a pin having a base axially receivable in said channel and a projecting part extending radially through and beyond said slot to form a tooth projecting laterally from the base of said pin, the base of said pin having a transverse dimension substantially greater than the width of said slot and opposing edge portions of said slot providing opposing undercut lips which extend over opposite side portions of the base of said pin and thereby serve as stops for engaging the base of said pin to secure said pin against lateral movement away from said bit body during rotation of said fastener with said key.

2. A locking system according to claim 1 wherein the socket of said fastener has a sidewall defining a chamber with a cross-sectional contour conforming to a cross-sectional contour of said bit body, and a groove in said chamber wall with a cross-sectional contour conforming to a cross-sectional contour of said tooth.

3. A locking system according to claim 1 wherein said pin is fixed in said channel by securing means.

4. A locking system according to claim 3 wherein said securing means is a layer of solder or an adhesive composition.

5. A locking system according to claim 1 wherein said pin is fixed in said channel by a layer of metal solder.

6. A locking system according to claim 1 wherein the cross-sectional area of the base part of said pin is greater than the cross-sectional area of said projecting tooth.

7. A locking system according to claim 1 wherein the traverse periphery of said tooth forms an arc of a circle.

8. A locking system according to claim 1 wherein said bit body has a substantially circular periphery interrupted by said slot.

9. A locking system according to claim 8 wherein said pin has a substantially circular cross section with a radius less than the radius of said circular periphery of the bit body.

10. A locking system according to claim 9 wherein the radius of said cross section of the pin is equal to or less than two-thirds of the radius of said circular periphery of the bit body.

11. A locking system according to claim 1 wherein said bit body has a substantially circular periphery interrupted by said slot, wherein said pin has a circular cross section with a radius less than the radius of said circular periphery of the bit body, wherein said cross section of the pin overlaps said cross section of the bit body to form said opposing lips of the slot, and wherein the center of said circular cross section of the pin is radially within an imaginary chord line connecting opposing edges of said opposing lips of the slot.

12. A locking system according to claim 11 wherein the radius of said circular cross section of the pin is equal to or less than two-thirds of the radius of said circular periphery of the bit body.

13. A locking system according to claim 1 wherein said channel extends axially beyond said slot to form an axial bore in said shank of the key, and wherein a portion of said pin extends axially into said axial bore.

14. A locking system according to claim 1 wherein the engaging means of said fastener comprises left-handed threads such that a loosening of said fastener requires clockwise rotation of said shaft.

15. A locking system according to claim 1 wherein said socket is located in a head of the fastener, the cross-sectional area of said head being larger than the cross-sectional area of said shaft of the fastener.

16. A locking system according to claim 15 further comprising closure means for closing an access opening into an enclosure, a part of said closure means having a bore for receiving said shaft and a counterbore for receiving said head, wherein said head is fully recessed in said counterbore when said fastener is secured in a locked position by said engagement between said engaging means and said retaining means, and wherein said fastener head has an external contour cooperating with a wall of said counterbore such that, when said head is fully recessed, said cooperation prevents removal of said fastener from said locked position by a tool capable of gripping said external head contour.

17. A locking system according to claim 16 wherein said closure means comprises a closure member for covering said access opening, and wherein said bore and said counterbore are provided in said closure member.

18. A locking system according to claim 17 wherein said closure member is a manhole cover.

19. A locking system according to claim 16 wherein said closure means comprises a closure member for covering an entrance opening into said enclosure, and a locking bar having an engaging portion for lockingly engaging said closure member when said fastener is in said locked position; and wherein said bore and said counterbore are provided in said locking bar.

20. A locking system according to claim 1 wherein said axial slot communicates with an external surface of said bit body, and wherein said tooth projects laterally beyond said external surface.

21. A locking system according to claim 1 wherein said socket is located in a head of the fastener, the cross-sectional area of said head being larger than the cross-sectional area of said shaft of the fastener; wherein said locking system further comprises closure means for closing an access opening into an enclosure; wherein said closure means comprises a closure member for covering said access opening into said enclosure, a locking bar having a base for engaging a wall of said enclosure and an engaging portion for lockingly engaging said closure member when said fastener is secured in a locked position by said engagement with said retaining means, an anti-rotation member receivable in a first bore of said locking bar for preventing rotation thereof when said fastener is in said locked position, and means for mounting said anti-rotation member on said enclosure wall; wherein said locking bar has a second bore for receiving said shaft and a counterbore for receiving said head; and wherein said head is recessed in said counterbore when said fastener is in said locked position and is movable between said locked position and an unlocked position where said anti-rotation member is released from said first bore such that said locking bar may rotate around said fastener to release said engaging portion from said locking engagement with said closure member.

* * * * *